US006318528B1

(12) United States Patent
Blanckaert

(10) Patent No.: US 6,318,528 B1
(45) Date of Patent: Nov. 20, 2001

(54) BAG, A FLAP FOR A BAG AND ITS METHOD ASSEMBLY

(75) Inventor: Christian Blanckaert, Paris (FR)

(73) Assignee: Hermes Sellier, Paris (FR)

( * ) Notice: Subject to any disclaimer, the term of this patent is extended or adjusted under 35 U.S.C. 154(b) by 0 days.

(21) Appl. No.: 09/369,244

(22) Filed: Aug. 5, 1999

(30) Foreign Application Priority Data

Aug. 6, 1998 (FR) ..... 98 10140

(51) Int. Cl.[7] ..... A45C 3/00; A45C 13/10

(52) U.S. Cl. ..... 190/119; 190/120; 190/902; 150/118; 383/84; 383/86

(58) Field of Search ..... 190/119, 120, 190/902; 150/103–105, 118; 383/84, 86

(56) References Cited

U.S. PATENT DOCUMENTS

| | | | | |
|---|---|---|---|---|
| D. 154,119 | * | 6/1949 | Gumbrill | 150/118 X |
| 1,562,408 | * | 11/1925 | Berkowitz | 150/103 |
| 1,727,954 | * | 9/1929 | Beehler | 190/119 |
| 2,023,144 | * | 12/1935 | Miller | 150/105 |
| 2,063,850 | * | 12/1936 | Nemeth et al. | 150/103 |
| 2,080,453 | * | 5/1937 | Kraut | 150/104 |
| 2,118,490 | * | 5/1938 | Goldberg | 150/105 |
| 2,210,351 | * | 8/1940 | Westenforf | 190/119 |
| 2,355,155 | * | 8/1944 | Greenfield | 150/104 |
| 2,737,221 | * | 3/1956 | Knox | 150/118 |
| 2,784,756 | | 3/1957 | Resnick | 150/105 |
| 3,954,128 | * | 5/1976 | Rushing et al. | 150/118 X |
| 4,687,036 | * | 8/1987 | Thomas | 150/118 |
| 4,907,633 | * | 3/1990 | Eckstein | 150/105 |

FOREIGN PATENT DOCUMENTS

| | | |
|---|---|---|
| 0 821 894 | 2/1998 | (EP) . |
| 2 629 794 | 10/1988 | (FR) . |
| 2 618 649 | 2/1989 | (FR) . |
| 2 757 751 | 7/1998 | (FR) . |
| 680835 | 10/1952 | (GB) . |
| 682729 | 11/1952 | (GB) . |

* cited by examiner

*Primary Examiner*—Sue A. Weaver
(74) *Attorney, Agent, or Firm*—Young & Thompson

(57) ABSTRACT

A bag includes a flap secured to the body of the bag, this flap being formed from a deformable piece and the bag further having at least two passages whose function is to allow the passage of a strap for the purpose of holding the flap on at least one wall of the body, the passages being situated at a sufficient distance from each other and disposed on the flap so that, when the flap is mounted on the body of the bag, the passages are opposite the wall in order to make it possible to secure the flap to the latter by the strap.

28 Claims, 8 Drawing Sheets

BAG, A FLAP FOR A BAG AND ITS METHOD ASSEMBLY

BACKGROUND OF THE INVENTION

It relates more particularly to a flap for a bag, intended to be mounted on the wall of the bag removably and without stitching, and a bag comprising this flap.

It also concerns the method of assembling the bag.

DESCRIPTION OF THE RELATED ART

The document U.S. Pat. No. 2,784,756 concerns a handbag having a removable covering leaf. The leaf or flap is held on the bag by means of clasps and a handle passing through the leaf. The handle and clasps are sewn onto the bag.

Such a flap is simply placed and held on the bag by the clasps and the handle. In addition, the clasps and handle are fixed to the bag by sewing or welding. As a result, producing the bag is in the end fairly complex and therefore expensive.

In addition, the opening in the bag is predetermined and fixed. It does not make it possible to adapt the volume of the bag according to its content.

SUMMARY OF THE INVENTION

The purpose of the invention is therefore to remedy these drawbacks.

To this end it proposes a bag in which the flap is mounted on the wall removably and without stitching, the opening in the bag being able to be adapted in accordance with the content.

A first object of the invention concerns a flap for a bag intended to be secured to the body of the bag, this flap being formed from a deformable piece comprising at least two passages whose function is to allow the passage of a strap for the purpose of holding the flap on at least one wall of the body, the passages being situated at a sufficient distance from each other and disposed on the flap so that, when the flap is mounted on the bag body, the passages are opposite the wall in order to make it possible to secure the flap to the latter by means of the strap.

The flap has, towards its rear longitudinal edge, two passages situated in the vicinity of its transverse edges.

According to a variant embodiment, it has at least two pairs of passages.

According to other characteristics, it has two passages situated in the vicinity of its middle part between its transverse edges.

It also has, close to its rear longitudinal edge, at least one first aperture for a locking system.

The first aperture is situated in the middle part between its transverse edges.

The flap has a second aperture for the locking system close to its front longitudinal edge.

The first and second apertures are disposed substantially opposite each other when the flap is folded on itself about a median longitudinal axis.

The first aperture is surrounded, on each side and close to it, by two passages for the securing strap.

The passages and the first aperture have the same general shape.

The passages and the first aperture are disposed along the same straight line substantially parallel to the rear longitudinal edge of the flap.

This flap also has at least one cutout for at least one handle to pass.

According to a variant, it has at least two cutouts or at least one pair of cutouts.

The cutouts are situated in the middle part between the front and rear longitudinal edges.

According to a variant, the cutouts are situated in the vicinity of its transverse edges.

According to another variant, the cutouts are situated in the vicinity of its middle part between its transverse edges.

A second object of the invention is a bag comprising a wall forming the container delimiting an opening and a flap as just described, associated with the wall so as to be able to cover the opening, in which the flap is mounted removably and without stitching on the said wall by means of a strap itself mounted for slight friction in loops on the wall in order not to escape therefrom unintentionally. According to other characteristics, the strap fulfils the functions firstly of the removable holding of the flap on the wall and secondly the closure of the opening by folding the bag wall on itself, the latter being shaped so as to form folds or bellows through which the strap passes so as to be able to be deployed, or on the other hand flattened.

The strap also has the function, thirdly, of the locking of the bag by cooperation with the locking system.

The bag wall forms, close to its rear longitudinal edge adjacent to the opening, a hem in which a rigid rod cooperates.

It also has at least one handle passing through the cutouts in the flap, provided at its two end parts with holes, these said end parts being housed in two scallops formed in the hem, the transverse rigid rod cooperating with the holes in the handle, so that the handle is mounted on the wall of the bag body removably and without stitching.

According to a variant, the bag has two handles mounted in the same pair of cutouts in the flap and scallops in the hem.

The locking system is in the form of a piece comprising:

- a plate;
- a journal projecting with respect to the plate;
- a first aperture provided in the journal adjacent to the plate;
- a projection projecting from the plate opposite to the journal.

The plate is positioned, interposed and immobilised between the internal face of the flap and the handle which holds it, which passes through the first aperture of the closure system.

The journal passes through a first aperture provided in the wall of the bag body against which the flap is applied and the projection passes through the first aperture in the flap.

Locking means are associated with the projection on the locking system.

The bag also has a second aperture provided in the wall of the bag body opposite to the first.

The journal of the locking system then passes through the second aperture when the bag is closed.

The free end parts of the strap are thus placed in the second aperture of the locking system placed outside the bag, these end parts being held in the locking system by the flap, which applies them against it.

The first and second apertures in the bag extend in the same direction, which is substantially parallel to the rear longitudinal edge.

A third object of the invention is a method of assembling a bag which has just been described, starting from a wall forming the bag body, a flap and a strap in which:

the flap is positioned with respect to the bag body;

the strap is slipped through the loops on the wall and through the passages in the flap;

the strap is tensioned;

the assembly thus being effected removably and without stitching.

First of all, the locking system is mounted on the flap and is made to cooperate with the first aperture in the wall.

The handle is next positioned in the cutouts in the flap and scallops in the hem; the rigid rod is slipped through the said hem; and the said rod is immobilised on the bag body.

BRIEF DESCRIPTION OF THE DRAWINGS

The invention will be clearly understood by means of the description which will follow with reference to the accompanying drawings, in which.

DESCRIPTION OF THE PREFERRED EMBODIMENT

Figure 1:
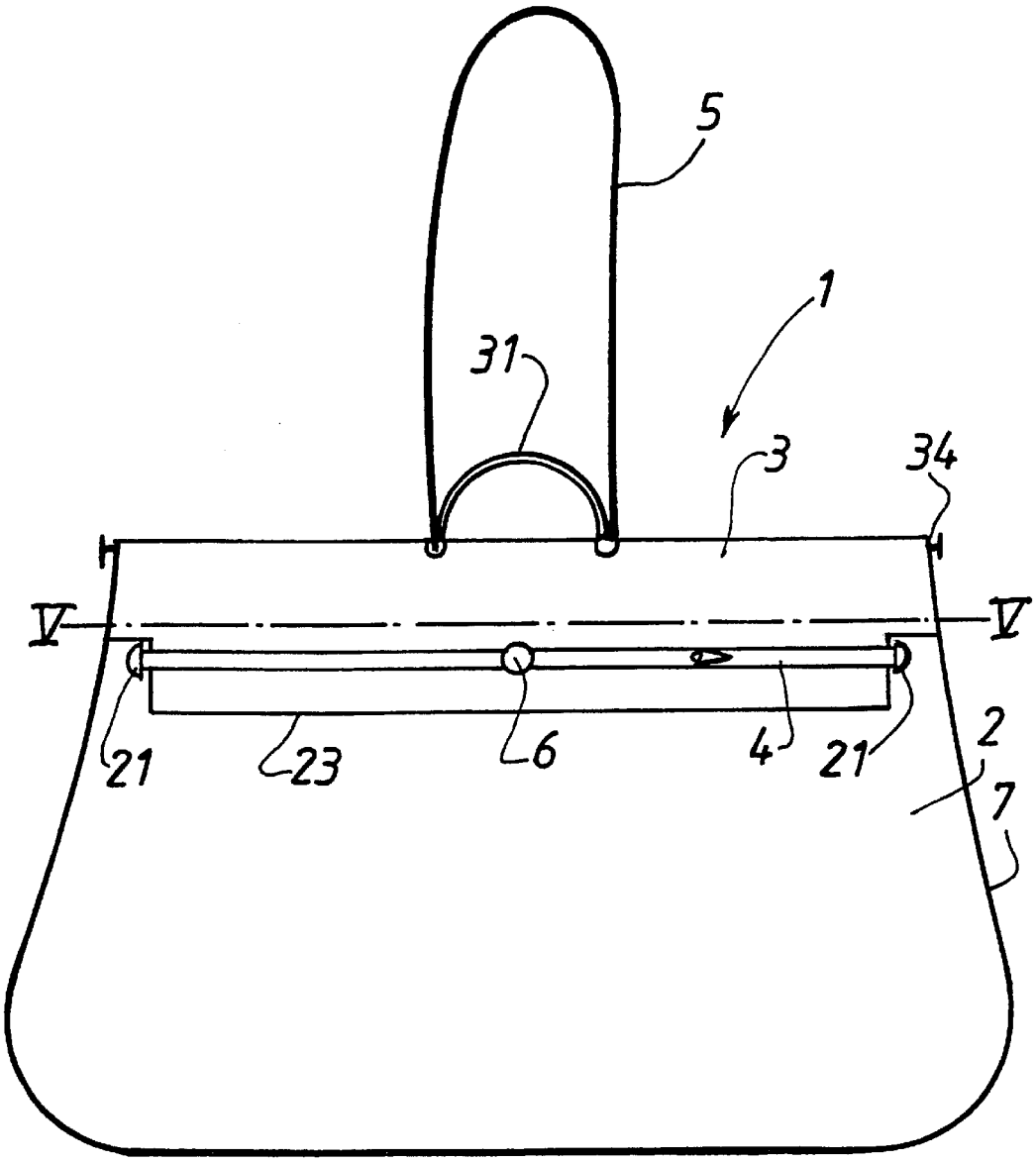
FIG. 1 is a front elevation view of the front face of the closed bag.

According to the embodiment illustrated in the figures, the bag 1 comprises:

a bag body 2;

a removable flap 3;

at least one strap 4 for for securing the flap 3 to the bag body 2;

at least one handle 5;

at least one locking system 6 for the bag 1.

The body of the bag 2 has the general shape of a substantially rectangular and hollow parallelepiped. It is formed by a wall 7 delimiting an opening 8.

This wall 7 comprises two rear and front longitudinal walls, 9 and 10 respectively, and two side walls 11, respectively face to face and substantially parallel in pairs.

It also comprises a seating wall 12, on which the bag 1 is intended to rest, situated on the opposite side to the opening 8 in the bag 1.

In the embodiment illustrated by the figures, the wall 7 is made in a single piece.

According to a variant embodiment, the wall 7 is produced by assembling several pieces, for example by stitching or the like.

The rear and front longitudinal walls 9 and 10 and the side walls 11 have, when flat, a substantially trapezoidal shape.

The small bases 13 of each trapezium thus delimit the opening 8 in the bag 1.

The rear longitudinal wall 9 comprises, at its rear longitudinal edge 14 adjacent to the opening 8, a hem 15 forming a tunnel. This hem 15 extends longitudinally, substantially parallel to the rear longitudinal edge 14. It is disposed so as to project from the opening 8 in the bag 1, on the opposite side to the wall 12.

It is formed by folding the wall 9 on itself, and is connected, by stitching or the like, to the rear longitudinal edge 14.

This hem 15 is intended notably to make it possible to hold the handle 5 on the body of the bag 2.

Two scallops 16 are provided in the hem 15. They are disposed in the middle region of the hem 15. These scallops 16 are intended to allow the passage of the handle 5 and its positioning on the body of the bag 2.

The wall 7 comprises on the one hand a first aperture 18 and on the other hand a second aperture 19, both intended to cooperate with the locking system 6.

The first aperture 18 is provided in the rear longitudinal wall 9, in its middle region on the same side as the rear longitudinal edge 14.

The second aperture 19 is provided in the middle region of the front longitudinal wall 10, on the same side as the front longitudinal edge 20.

The two apertures 18 and 19 are disposed substantially opposite each other.

The wall 7 also comprises loops 21, 21*a* intended to allow passage of the securing strap 4.

Figures 3, 11:
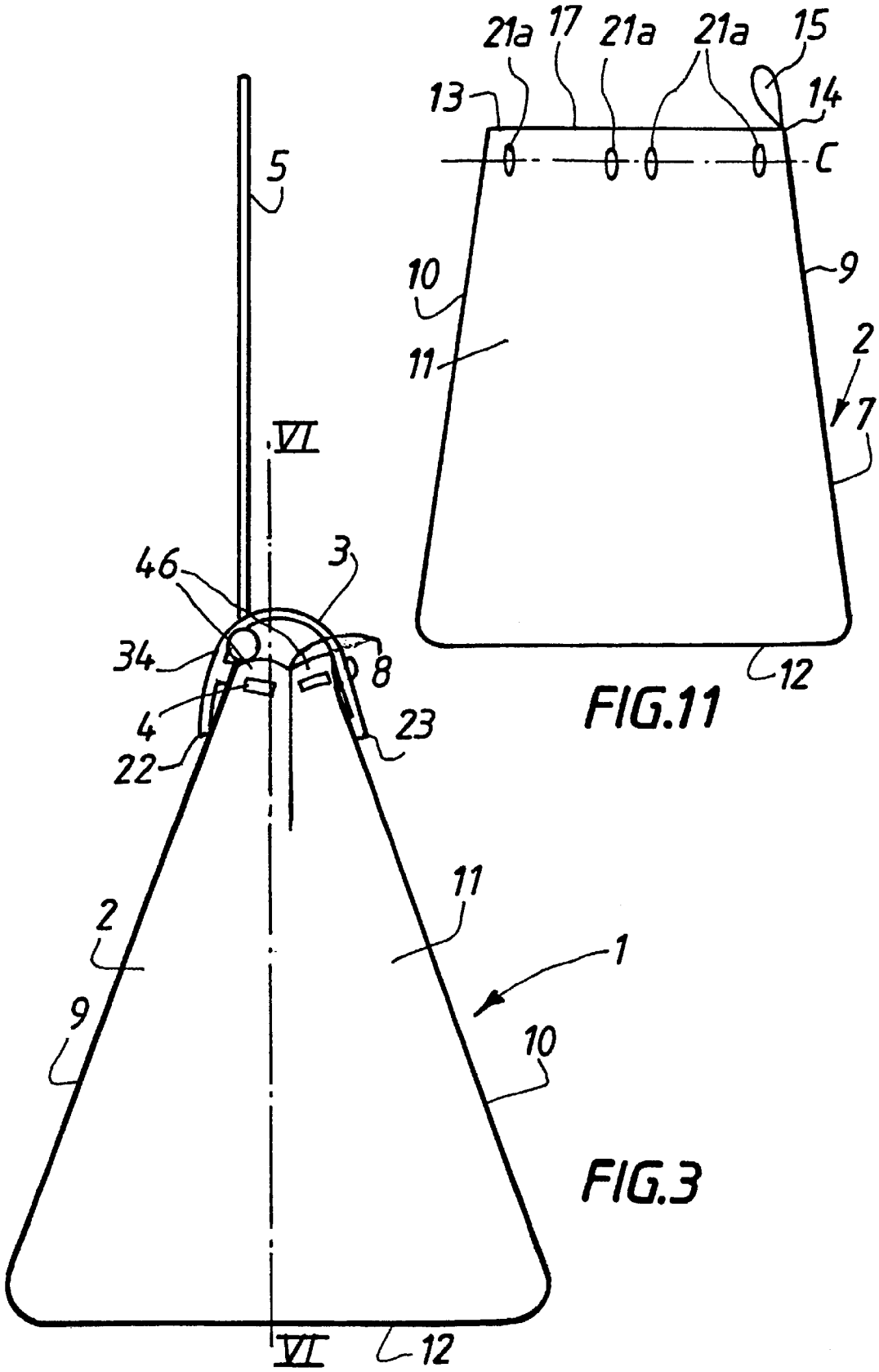
FIG. 3 is a side elevation view of the closed bag.
FIGS. 9, 10 and 11 are views in elevation of the front, rear and side faces of the bag body.
Figure 9:
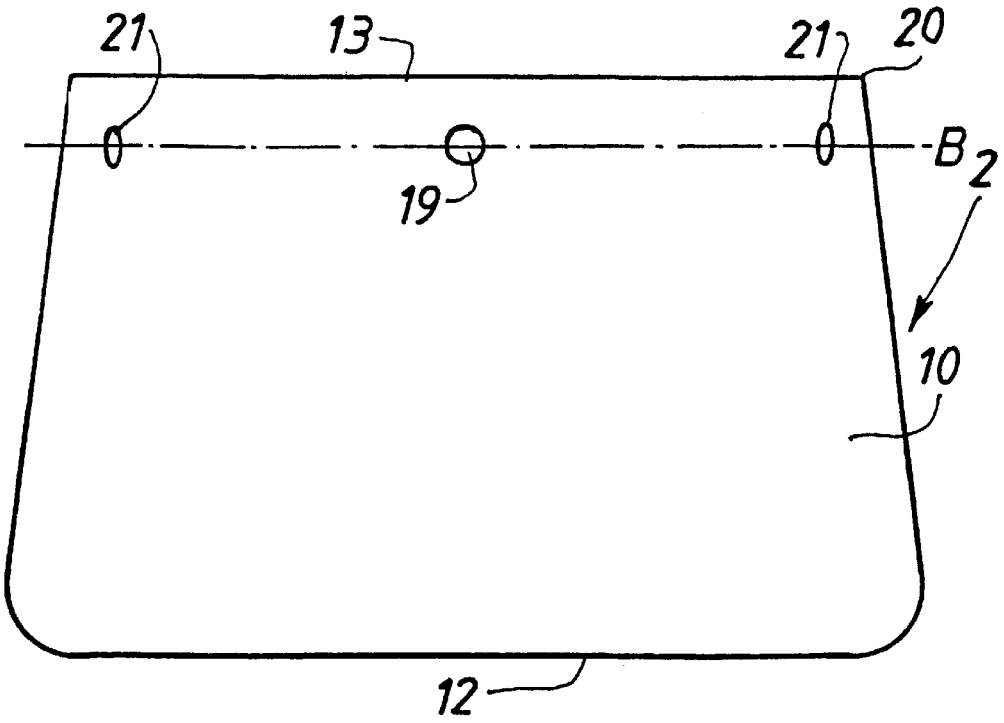
Figure 10:
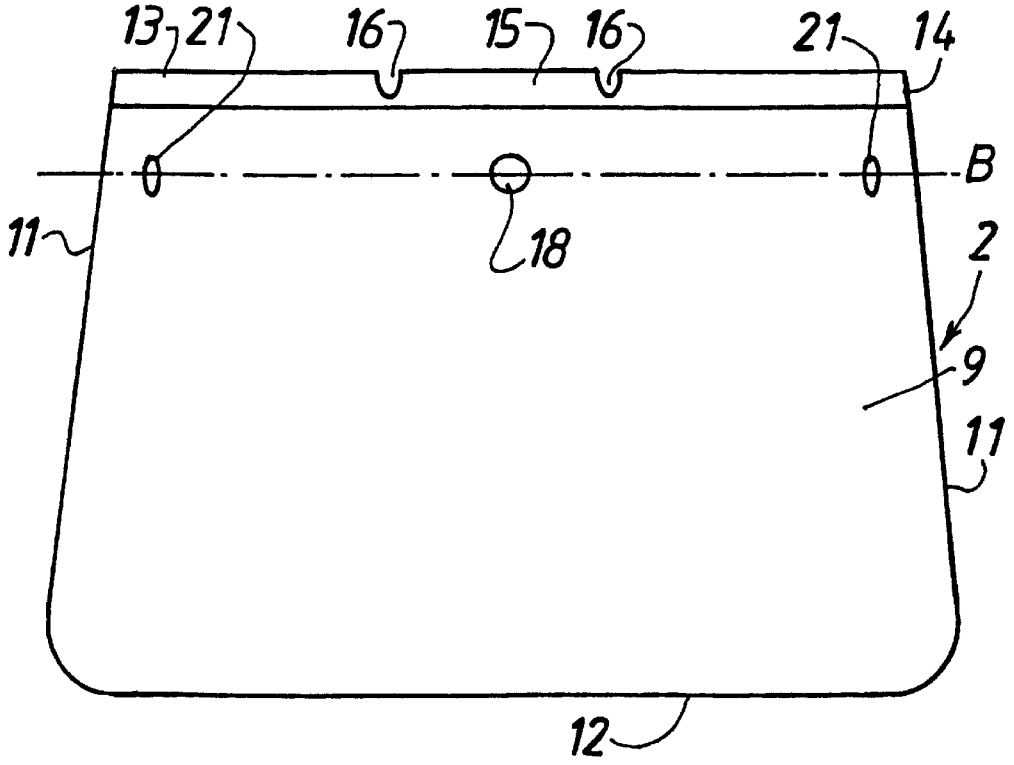

According to the embodiment illustrated in FIGS. 9, 10 and 11, the body 2 comprises two openings 21 on each longitudinal wall 9 and 10. These openings 21 are each disposed substantially at an equal distance from the apertures 18 and 19, close to the lateral edges 17.

These openings 21 and the first and second apertures 18 and 19 are disposed substantially in alignment one after the other, in a direction B substantially parallel to the longitudinal edge 20 or 21.

In each side wall 11, four openings 21*a* are provided. The openings 21*a* are disposed close to the side edges 17. They are substantially aligned one after the other in a direction C substantially parallel to the side edges 17.

The opening 8 in the body of the bag 2 is covered when the bag is closed, by a removable flap 3, not sewn to the body of the bag 2.

This flap 3 has, when flat, a substantially rectangular overall shape. It has two longitudinal edges, respectively rear and front 22, 23, and two transverse edges 24. These edges are disposed opposite each other and substantially parallel in pairs.

The flap 3 comprises, between its transverse edges 24, at least one cutout 25 intended to allow passage of the handle 5.

Figure 4:
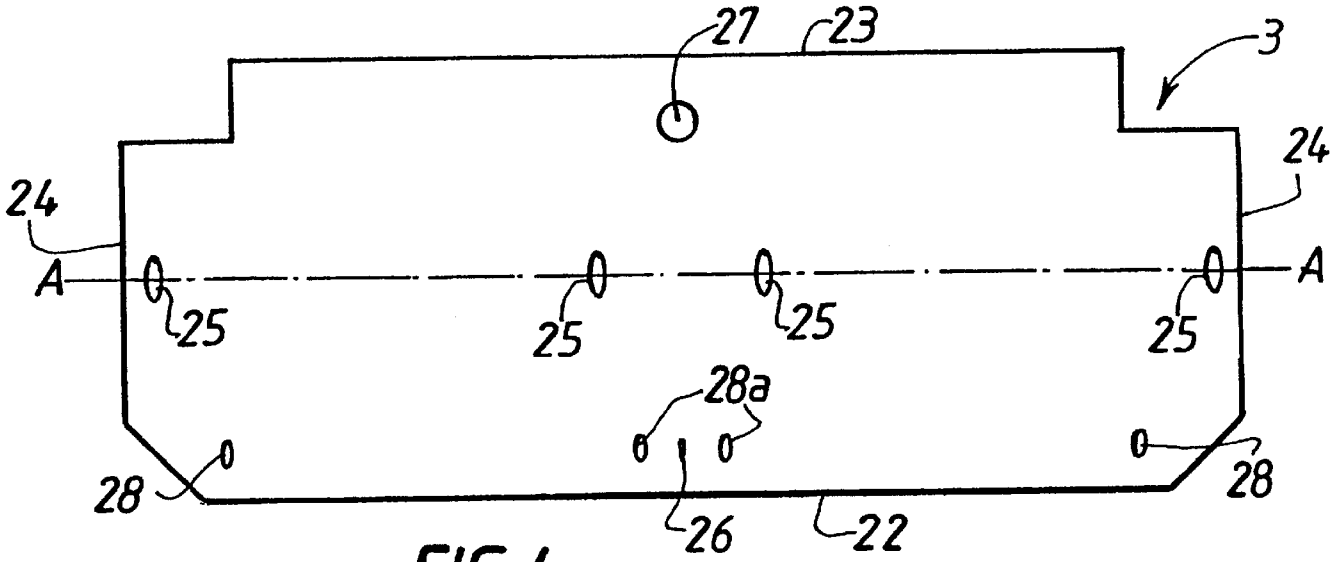
FIG. 4 is a plan view of solely the flap when flat.
Figure 5:
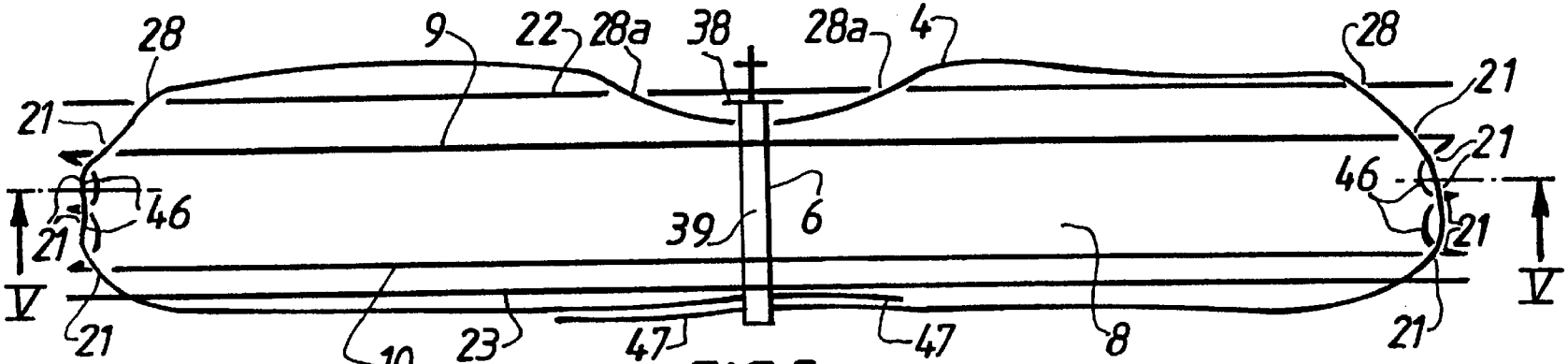
FIG. 5 is a view in section along the line V—V in FIG. 1.
Figure 12:
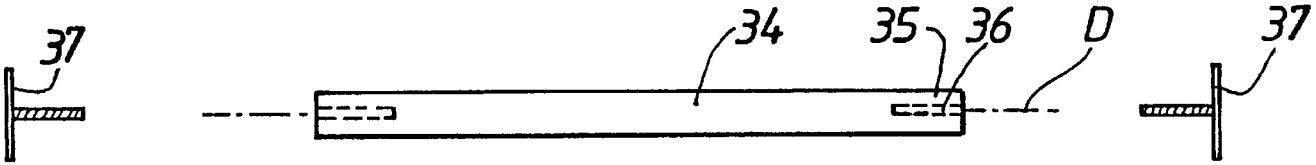
FIG. 12 is an exploded view of the rigid rod and the screws which cooperate with it.
Figure 6:
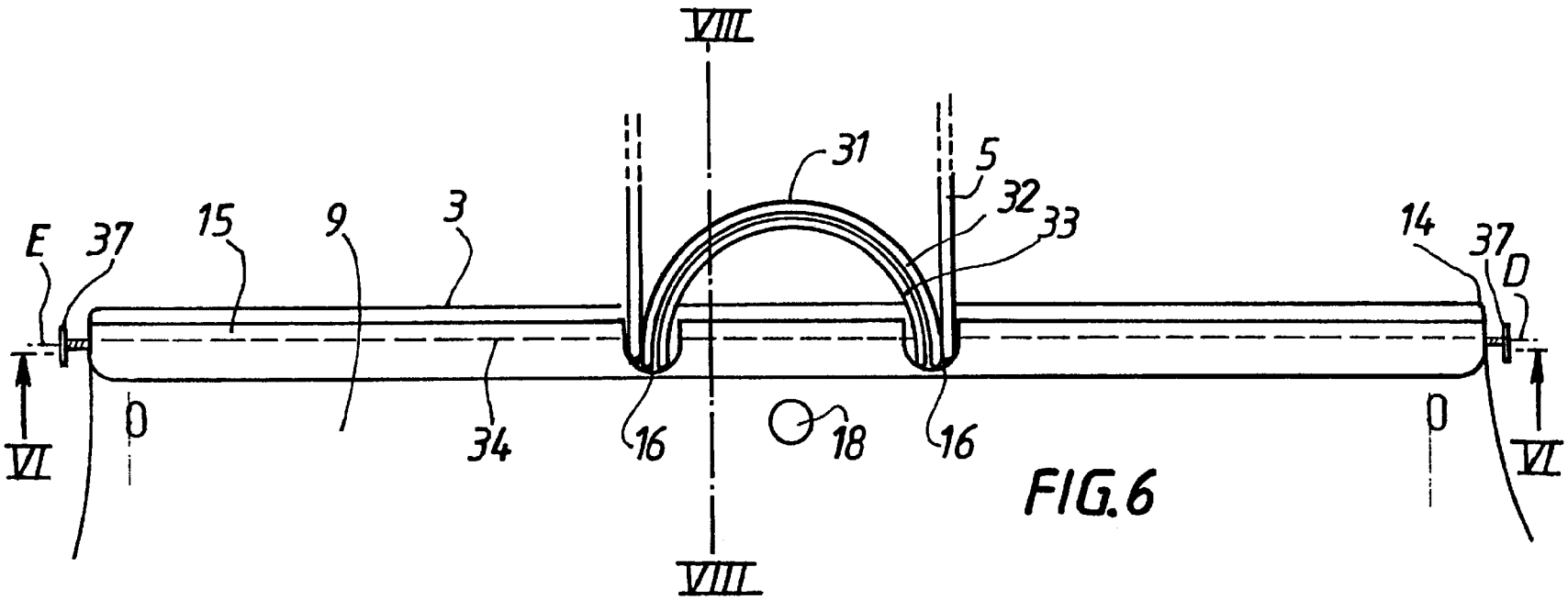
FIG. 6 is a view in longitudinal section along the line VI—VI in FIG. 3.
Figure 7:
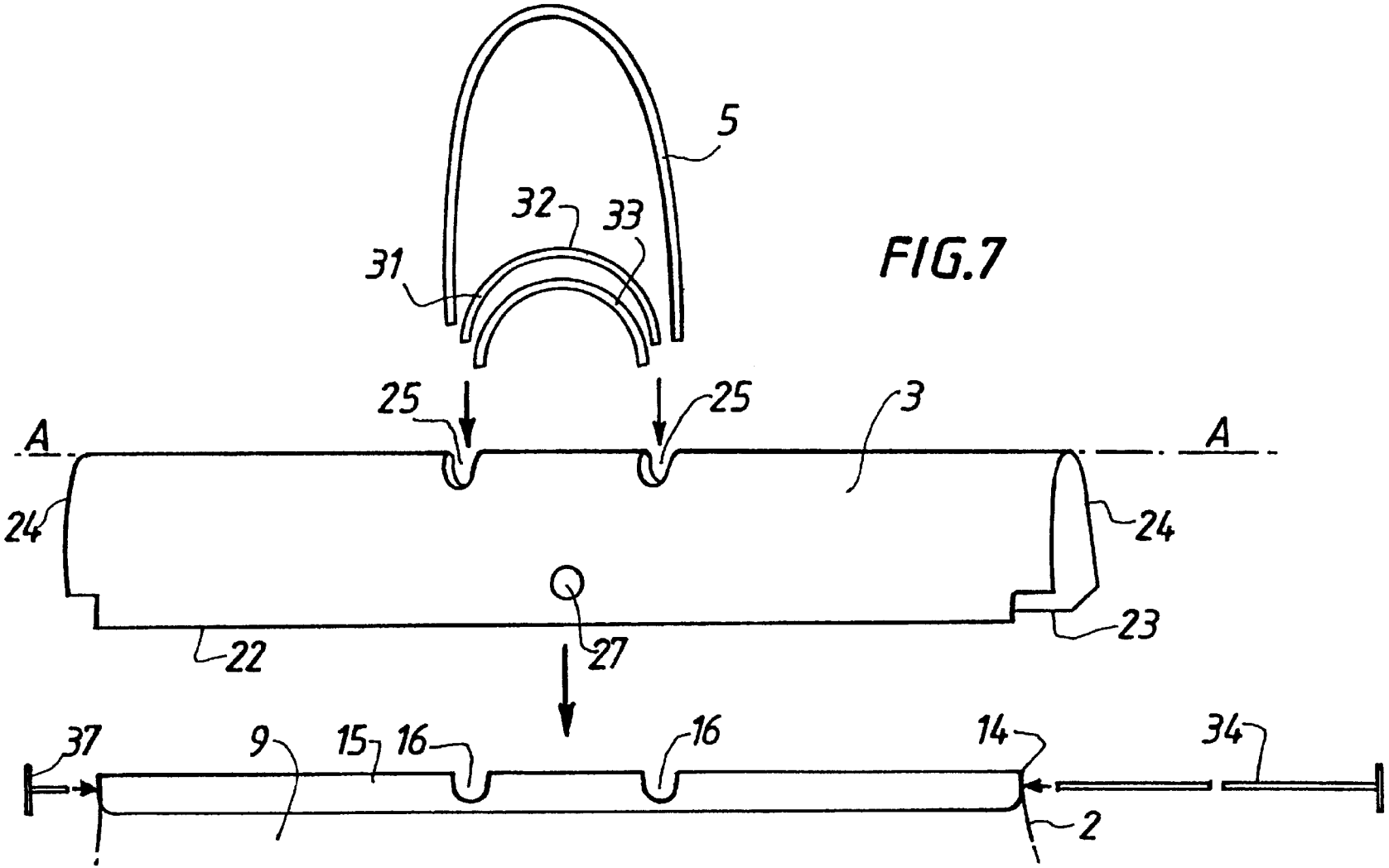
FIG. 7 is an exploded view of the removable fixing system for the flap and handles on the bag body.
Figure 14:
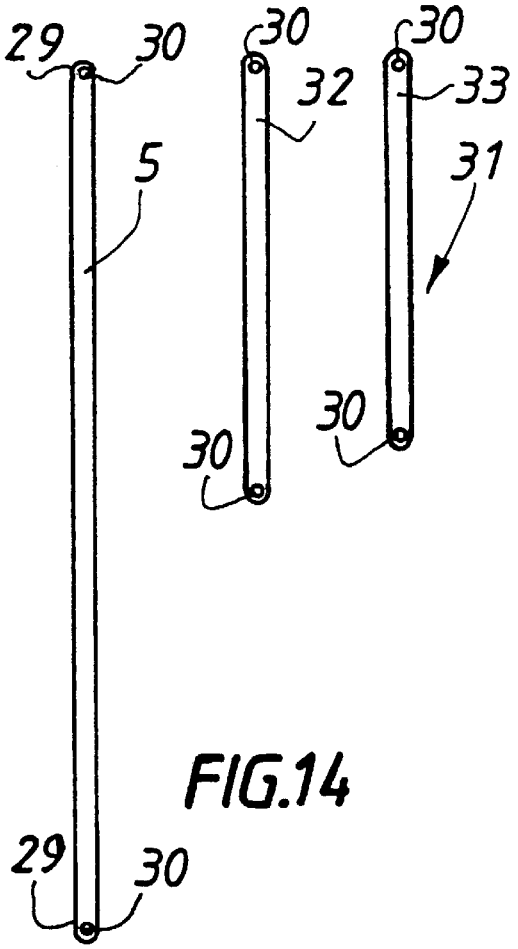
FIG. 14 depicts a plan view of the different elements making up the handles.
Figure 8:
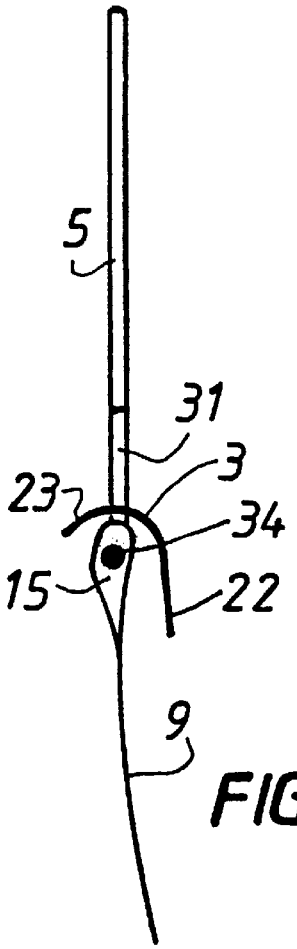
FIG. 8 is a view in section along the line VIII—VIII in FIG. 6.

In the embodiment illustrated in FIG. 4, the flap 3 comprises two cutouts 25.

A first aperture 26 is provided in the flap 3, in the middle region adjacent to the rear longitudinal edge 22.

A second aperture 27 is provided opposite this first aperture 26, in the middle region adjacent to the front longitudinal edge 23 of the flap 3.

These first and second apertures 26 and 27 are intended to cooperate with the locking system 6.

Passages 28, 28*a* are provided along the rear longitudinal edge 22 in alignment with each other and with the first aperture 26.

In FIG. 4, they are four in number. Two passages 28*a* are disposed in the middle region, at equal distances on each side and close to the first aperture 26, whilst the other two passages 28 are provided close to the side edges 24, at equal distances from the first aperture 26.

These passages 28 and 28*a* are intended to allow passage of securing strap 4 in the flap 3.

The cutouts 25, apertures 18 and 19 and passages 28, 28*a* each have an elongate or oblong overall shape.

In the embodiment illustrated in FIG. 4, these cutouts 25, apertures 18 and 19 and passages 28 and 28*a* extend in parallel with respect to the transverse edges 24.

The flap 3 is formed by a substantially flexible material whilst having a certain strength. It is produced for example from leather or thick leather substitute.

In the embodiment illustrated in FIG. 3, the flap 3 is preformed. It is for example curved about a median longitudinal axis A. The concavity is then turned towards the opening 8 of the bag 1.

This flap 3 is intended to be mounted on the wall 7 of the body 2 removably and without stitching. It is held on the bag 1 in cooperation notably with the securing strap 4 and handle 5.

The securing strap 4 has the shape of an open section extending longitudinally. Its length is at least equal to the perimeter of the bag 1 adjacent to the opening 8.

Its transverse dimension is determined according to the dimension of the loops 21, 21*a* and passages 28, 28*a*.

Thus its transverse dimension is substantially the same as that of the loops 21, 21*a* and passages 28, 28*a*, so that the strap 4, once mounted on the wall 7 and flap 3, does not unintentionally escape from the loops 21, 21*a* and passages 28, 28*a*.

The two end parts 47 of the strap 4 are intended to cooperate with the locking system 6.

This strap 4 has a certain flexibility and is produced for example from leather or leather substitute.

The handle 5 has the shape of a section extending longitudinally, provided at each of its end parts 29 with holes 30.

It is intended to be mounted in the cutouts 25 in the flap 3 and scallops 16 in the hem 15.

This handle 5 is produced, for example, from leather or leather substitute.

In a preferred embodiment, the bag 1 has two handles 5, 31. A first long handle 5, making it possible to carrying the bag 1 across the shoulder, and a second short handle 31, for carrying the bag 1 in the hand.

The short handle 31 is produced by placing two pieces of leather 32 and 33 one on top of the other, the two faces on the flesh side being against each other.

In this case, the two handles 5 and 31 are mounted in the same pairs of cutouts 25 and scallops 16.

The handle 5 is held on the bag 1 by cooperation with a rigid rod 34 inserted into the hem 15.

This rigid rod 34 has a longitudinal axis D parallel to the longitudinal axis E of the hem 15.

It has, at each of its end parts 35, a housing 36 intended to allow the insertion of a removable projecting head 37.

This projecting head 37 has, for example, the shape of a flat-headed nail.

Thus the rigid rod 34 is mounted removably, but in a captive fashion, on the bag 1 by screwing the projecting heads 37 into the housings 36.

The locking system 6 is intended to cooperate with the first and second apertures 18 and 19 in the body 2 of the bag 1 and the first and second apertures 26 and 27 in the flap 3 respectively.

The locking system 6 has the shape of a piece extending longitudinally, for example cylindrical or parallelepipedal or with a similar shape.

This piece comprises on the one hand a plate 38 and a journal 39. The journal 39 projects with respect to the plate 38, its longitudinal axis F being substantially perpendicular to the plate 38.

First and second apertures 40, 41 are provided in the journal 39. The first aperture 40 is disposed in the end part 42 adjacent to the plate 38. The second aperture 41 is disposed in the end part 43, opposite to the plate 38.

These apertures 40, 41 are intended to cooperate with the securing strap 4.

The locking system 6 also comprises a projection 44 projecting from the plate 38, opposite to the journal 39.

Figure 13A:
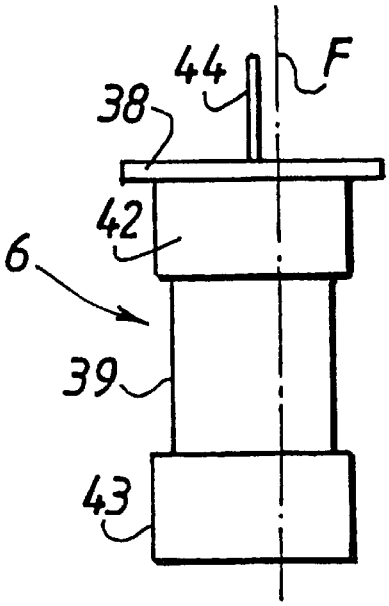
FIG. 13 depicts the closure system alone in plan view (13*a*) and in side view (13*b*)
Figure 13B:
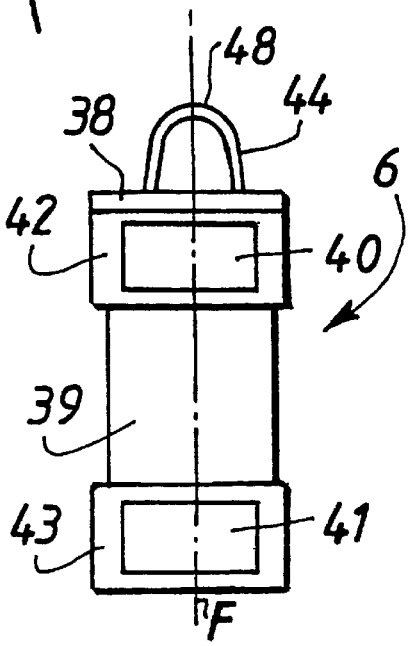

In FIG. 13*b*, the projection 44 forms a ring 48 fitted into the plate 38. This ring 48 is intended to cooperate with locking means 45.

Figure 2:
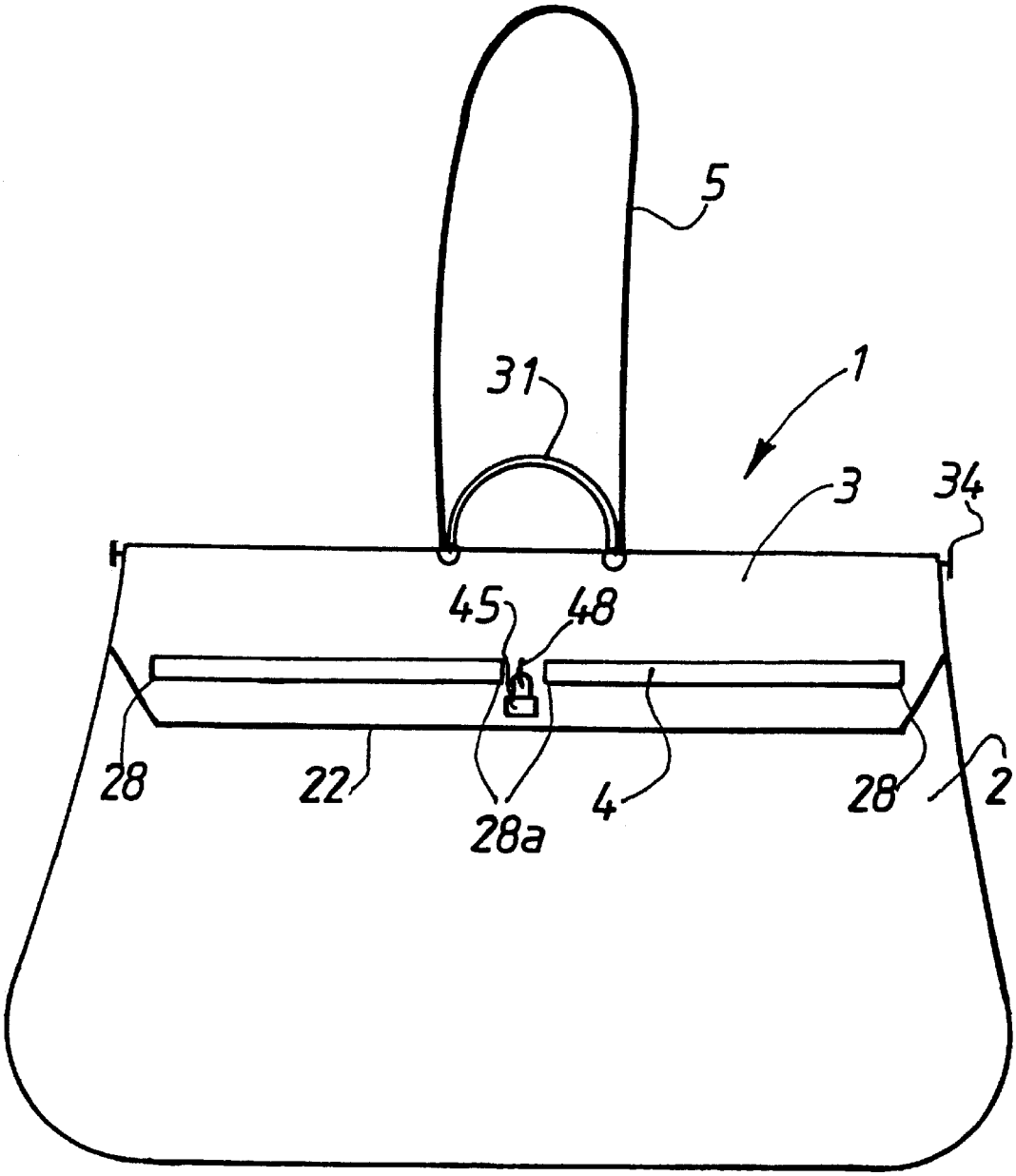
FIG. 2 is a front elevation view of the rear face of the closed bag.

These locking means 45 are, for example, in FIG. 2, a padlock.

The connection of the removable flap 3 to the bag 1, without stitching, is described below.

Firstly, the locking system 6 is mounted on the flap 3.

The end parts 42, 43 of the journal 39 are inserted respectively into the first aperture 26 and the second aperture 27 in the flap 3.

The first and second apertures 40, 41 in the journal 39 are then projecting towards the outside respectively of the front longitudinal edge 23 and rear longitudinal edge 22 of the flap 3.

Then the flap 3 is positioned with respect to the body 2 of the bag 1, so that the cutouts 25 in the flap 3 are opposite scallops 16 provided in the hem 15 of the body 2 of the bag 1.

Next, the handle 5 or handles 5, 31 is or are connected to the body 2 of the bag 1 and to the flap 3.

The end parts 29 of the handle 5 are inserted into the cutouts 25 in the flap 3, and then into the scallops 16 in the hem 15.

The rigid rod 35 is then slipped into the hem 15 and passes through holes 30 in the handle 5 and handle 31.

The rod 34 is fixed to the body 2 of the bag by the insertion of a projecting head 37 at each of these end parts 35.

The handle 5 or handles 5, 31 are thus mounted and trapped removably and without stitching on the bag 1.

When the bag is closed, the locking system 6 come to cooperate with the apertures 18 and 19 in the body 2.

The end part 42 is inserted in the first aperture 18 in the body 2.

Whilst the end part 43 is inserted in the second aperture 19, the apertures 40 and 41 in the journal 39 are then projecting outwards.

The locking system 6 is maintained in position on the flap 3 and body 2 by the locking means 45.

The locking means 45 are, for example, a padlock inserted into the ring 48 which immobilises the locking system 6 on the rear longitudinal wall 9 of the body of the bag 2.

The flap 3 then covers the opening 8 of the bag 1, closing it, secured to the body 2 of the bag 1 by the strap 4.

This strap 4 is mounted both on the body of the bag 2 and the flap 3.

It is disposed at the periphery of the body of the bag 2.

It is mounted for friction in the loops 21, 21*a* on the body of the bag 2 and the passages 28, 28*a* in the flap 3.

It passes likewise through the first and second apertures 40, 41 in the locking system 6, thus making it possible to lock the closure of the bag 1.

The free end parts 47 of the strap 4 are then placed one on top of the other in the second aperture 41 of the locking system 6.

They are maintained in position by the flap 3.

Thus the flap 3 is mounted and secured to the wall 7 of the bag 1 by the securing strap 4, cooperating both with the handles 5, 31 and the locking system 6.

In order to open the bag 1, the flap 3 is simply tilted towards the rear longitudinal wall 9 of the bag 1. It is held on this wall 9, both by the handles 5 and 31, the strap 4 and the locking system 6 cooperating with the locking means 45.

In addition, the use of the securing strap 4 makes it possible to close the bag 1 according to the opening 8 required.

Thus, by greatly tensioning the strap 4, the wall 7 of the bag 1 is folded. This creates folds or bellows 46 at each side wall 11.

The minimal opening 8 and therefore the closure of the body 2 of the bag 1 is thus obtained when the folds 46 are completely flattened.

A maximum opening 8 is obtained by greatly releasing the strap 4, and the folds 46 are then completely deployed.

It is possible to confer different dimensions on such a bag 1 according to the use which is made thereof.

Thus this bag 1 can be used as a travelling bag or a handbag in particular.

What is claimed is:

1. A bag comprising:

a body (2) having at least one wall (7) and an opening (8);

a flap-securing strap (4) having two ends free; and a flap comprising a deformable piece of a material with a first pair of passages (28) for accepting the strap (4) and for being held on the at least one wall (7) of the body (2) of the bag (1), wherein the first pair of passages being sufficiently spaced apart and disposed on the material of the flap so that the strap (4) secures the flap at the first pair of passages against the at least one wall (7) of the bag (1), and the opening can be adjusted by tightening or loosening the strap and having a distance between the two free ends of the strap vary.

2. The bag of claim 1, the flap further comprising a second pair of passages **(28*a*)**.

3. The bag of claim 2, wherein the second pair of passages are located within a mid-region intermediate two flap transverse edges (24).

4. The bag of claim 3, further comprising a first locking system aperture (26) located adjacent a flap rear longitudinal edge (22).

5. The bag of claim 4, wherein the first locking system aperture (26) is located within a mid-region intermediate the two flap transverse edges (24).

6. The bag of claim 4, further comprising a second locking system aperture (27) located adjacent a flap front longitudinal edge (23).

7. The bag of claim 6, wherein the first and second locking system apertures are located substantially in alignment with the flap being folded about a median longitudinal axis (A).

8. The bag of claim 5, wherein the first locking system aperture (26) is located intermediate the second pair of passages **(28*a*), the first locking system aperture (26) together with the second pair of passages (28*a*) form a straight line substantially parallel to the rear longitudinal edge (22)**, and the second pair of passages are adapted to accept the strap.

9. A flap for a bag (1) with a body (2) having at least one wall (7) and a flap-securing strap (4), the flap comprising:

a deformable piece of a material with a first pair of passages (28) for accepting the strap (4) and for being held on the at least one wall (7) of the body (2) of the bag (1), the first pair of passages being sufficiently spaced apart and disposed on the material of the flap so that the strap (4) secures the flap at the first pair of passages against the at least one wall (7) of the bag (1), and at least one handle cutout (25) located within an interior region of the deformable piece of material.

10. The flap of claim 9, wherein the at least one handle cutout (25) comprises two cutouts.

11. The flap of claim 10, wherein the two cutouts are located midway between the rear longitudinal edge (22) and the front longitudinal edge (23).

12. The flap of claim 10, wherein each of the two cutouts are located near each of two flap traverse edges (24), respectively.

13. The flap of claim 10, wherein the two cutouts are located in a middle region intermediate two flap traverse edges (24).

14. The flap of claim 10, wherein the first and second pair of passages, the first and second locking system apertures, and the cutouts are each of an elongated shape and extend along respective major axes parallel to the two flap traverse edges.

15. The flap of claim 10, wherein the flap is curved about a median longitudinal axis (A).

16. A bag comprising:

a wall (7) forming a container and delimiting a bag opening (8), the wall (7) having strap openings (21) adjacent the bag opening (8);

a strap (4);

a flap (3) removable secured to the wall (7), secured free of any stitching, by the strap (4), the flap comprising a deformable piece of a material with a first pair of passages (28) for accepting the strap (4) and for being held on the wall (7) of the bag (1) by the strap (4) passing through each of the strap openings (21), the first pair of passages being sufficiently spaced apart and disposed on the material of the flap so that the strap (4) secures the flap at the first pair of passages against the wall (7) of the bag (1), the wall (7), strap openings (21), and strap (4) arranged and configured to close the bag opening (8) by folding the wall (7) onto itself, the wall shaped so as to form folds through which the strap passes, via said strap openings, in opening or closing the bag opening (8); and a locking system (6) operable in co-operation with the strap (4) to lock the bag opening (8).

17. The bag of claim 16, wherein the strap opening (21) are located along a periphery of the wall (7) at the bag opening (8).

18. The bag of claim 16, wherein the strap (4) comprises two ends which co-operate with the locking system (6).

19. The bag of claim 18, wherein the wall (7) further comprises a rear longitudinal edge (14) having a hem (15) and a rigid rod (34) inserted through the hem (15).

20. The bag of claim 19, wherein the rigid rod comprises a first end with a projecting head removably mounted by screwing.

21. The bag of claim 20, wherein the flap (3) further comprises at least two handle cutouts (25);

the hem (15) having two scallops (16); and at least one handle (5) passing through the at least two handle cutouts (25), the handle (5) having two end parts, each of the two end parts having a hole (30) housed in one of the two scallops and secured, without stitching, by the rigid rod (34).

22. The bag of claim 21, wherein the at least one handle (5) comprises two handles passing through the at least two handle cutouts, housed in the two scallops, and secured, without stitching, by the rigid rod.

23. The bag of claim 22, wherein a first of the two handles has a length longer than a second of the two handles.

24. The bag of claim 16, wherein the locking system comprises:

a plate (38);

a journal (39) projecting with respect to the plate (38);

a first aperture (40) located in the journal (39) adjacent to the plate (38); and a projection section (44) projecting from the plate (38) opposite to the journal (39).

25. The bag of claim 24, the wall further comprising a first lock aperture (18); and the flap further comprises a first flap lock aperture (26), wherein the plate (38) is positioned, interposed and immobilized between an internal face of the flap (3) and the strap (4), the strap (4) passes through the first aperture (40) located in the journal (39), the journal (39) passes through the first lock aperture (18), and the projection passes through the first flap lock aperture (26).

26. The bag of claim 24, further comprising a lock (45) engaged with the projection (44) on the locking system (6).

27. The bag of claim 25, the wall further comprising a second lock aperture (19) located opposite the first lock aperture (18);

the journal (39) further comprising a second aperture (41); and the strap (4) further comprising two free end parts (47), wherein the journal (39) passes through the second lock aperture (19) when the bag is closed, the two free end parts (47) of the strap (4) pass through the second aperture (41) of the journal (39), and the second aperture (41) and the two free end parts (47) exposed to an exterior of the bag.

28. The bag of claim 27, the wall (7) further comprising a rear longitudinal edge (14); and wherein the first and second lock apertures extend in the same direction substantially parallel to the rear longitudinal edge (14).

* * * * *